United States Patent [19]

Stewart

[11] 4,285,394

[45] Aug. 25, 1981

[54] MANIFOLD HEAT EXCHANGER

[76] Inventor: James M. Stewart, 115 Sylvan Way, Greenville, S.C. 29606

[21] Appl. No.: 859,977

[22] Filed: Dec. 12, 1977

[51] Int. Cl.[3] ..... F28D 15/00

[52] U.S. Cl. ..... 165/104.21; 165/DIG. 12; 122/33

[58] Field of Search ..... 165/105, DIG. 12; 122/33; 62/333

[56] References Cited

U.S. PATENT DOCUMENTS

| | | | |
|---|---|---|---|
| 1,619,660 | 3/1927 | Field | 165/105 X |
| 1,863,938 | 6/1932 | Smith | 62/333 X |
| 2,013,515 | 9/1935 | Heitman | 165/105 X |
| 2,835,480 | 5/1958 | Perez | 165/105 X |
| 2,966,033 | 12/1960 | Hughel | 165/105 X |
| 3,433,929 | 3/1969 | Snelling | 165/105 X |
| 3,788,388 | 1/1974 | Barbmann | 165/105 X |
| 4,080,957 | 3/1978 | Bennett | 165/105 X |

FOREIGN PATENT DOCUMENTS

| | | | |
|---|---|---|---|
| 767086 | 1/1957 | United Kingdom | 165/105 |
| 526760 | 12/1976 | U.S.S.R. | 165/105 |

OTHER PUBLICATIONS

Hughes, *Heatbank,* Electron Dynamics Division, Hughes Aircraft Co., Torrance, Cal., (90509), 10/1975.

*Primary Examiner*—Albert W. Davis
*Attorney, Agent, or Firm*—Bailey, Dority & Flint

[57] ABSTRACT

A heat exchange apparatus is illustrated, which may be used as in a stream of solar heated air for heating flowing water, wherein an array of heat pipes is utilized in heat exchange relation with a manifold, wherein vapor medium is exchanged therebetween for conducting heat from one to the other.

5 Claims, 4 Drawing Figures

MANIFOLD HEAT EXCHANGER

BACKGROUND OF THE INVENTION

Heat pipes have been used in connection with the heating and cooling of various structures. For example, U.S. Pat. No. 3,788,388 illustrates the use of heat pipes in a regenerator to exchange heat between intake air as it flows into an enclosure and exhaust air as it flows out of the enclosure. For this purpose a plurality of sealed heat tubes are disposed in generally parallel relationship, one end being disposed in heat exchange relationship with the intake air and the other being exposed to the exhaust air. The patent illustrates generally, heat tubes of the type which may be employed with the present invention. Suitable heat pipes are also illustrated in U.S. Pat. No. 3,753,364. Heat tubes useful in connection with the present invention may be constructed with or without wicking members and if as illustrated herein, those without wicking members are employed, it is preferred that the horizontal array of heat tubes be tilted slightly toward one end.

An important object of the invention is to provide an improved heat exchange apparatus employing an array of heat tubes all of which have connection with a manifold element so that the array and the manifold are in heat transfer relation.

Another important object of the invention is to provide a heat exchange apparatus which may be especially useful in connection with heating flowing water by means of solar heated air as may be provided by a solar collector so that the air passes through the heat exchange apparatus to transfer heat from the air to the flowing water.

SUMMARY OF THE INVENTION

It has been found that a versatile heat exchange apparatus is capable of efficiently and very rapidly conducting heat from one element to another by providing an array of heat tubes which are connected to a manifold so that vapor may be moved therebetween to effect heat transfer.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
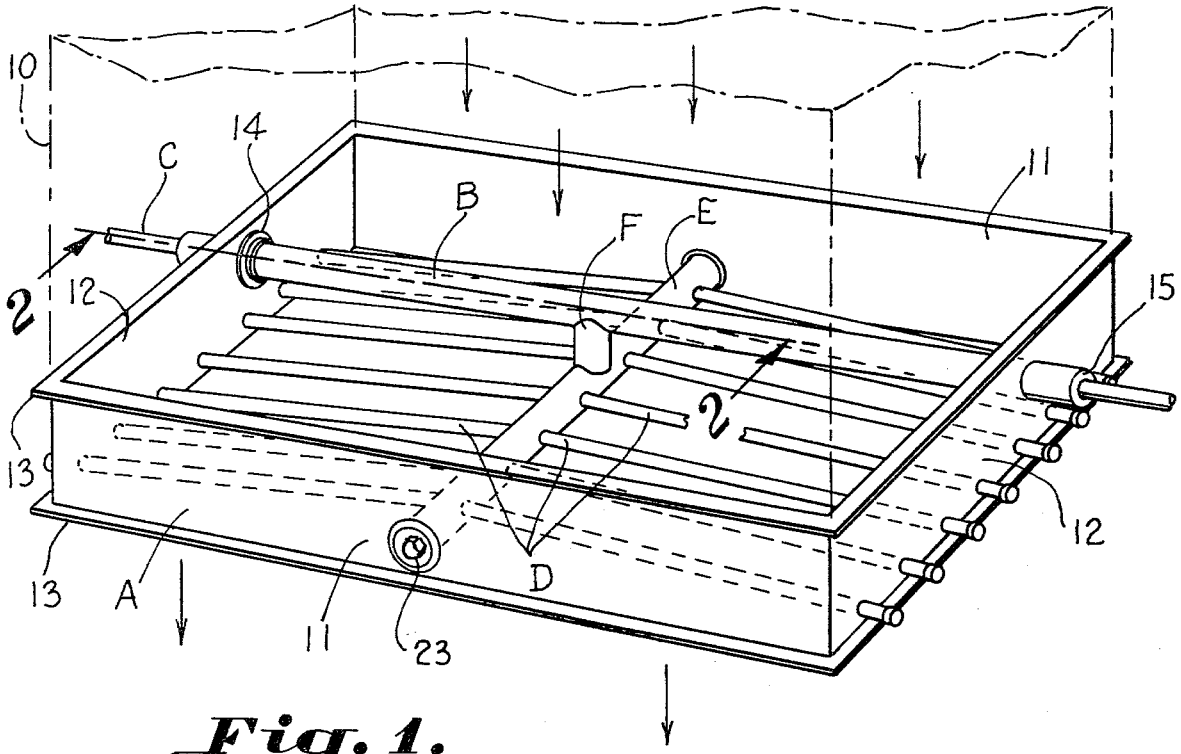
FIG. 1 is a schematic, perspective view illustrating a heat exchange apparatus constructed in accordance with the present invention positioned within the air flow of a duct carrying air from a solar collector.

The drawing illustrates heat exchange apparatus utilized in a stream of solar heated air for heating flowing water. An open frame A accommodates the passage of an air stream therethrough. An elongated manifold B is carried in the frame and a pipe C for carrying flowing water extends longitudinally in heat transfer relation with the manifold in spaced relation thereto. A plurality of spaced heat tubes D have a vaporizable medium therein and are carried in the frame beneath the manifold. Means for collecting vapor from the heat tubes includes a collector pipe E and means for conveying the vapor into the manifold into heat exchange relation to the water within the pipe includes an upright conduit F. If desired, the manifold may be positioned within the water pipe rather than outside as illustrated. Thus, the vapor from the heat tubes condenses in the manifold giving up its latent heat to the water.

While the embodiment of the invention illustrated is described in connection with utilizing solar heated air, it is to be understood that the combination of heat tubes and manifold illustrated and described herein may be adapted to many other uses where heat is transferred from one fluid to another fluid whether gas to gas, gas to liquid, etc.

A duct for carrying heated air from a solar collector is illustrated in broken lines in FIG. 1 and is designated at 10. The duct 10 carries downwardly flowing air, as illustrated by the arrows in FIG. 1. In the embodiment illustrated in FIGS. 1 and 2, the vaporizable medium in the heat tubes takes on heat from the solar heated air and the vapor formed thereby is collected in the collector pipe and passes through the upright conduit or stand pipe F into the manifold where it gives up its latent heat to the water contained within the pipe which passes longitudinally therethrough.

The open frame A is illustrated in the form of a rectangular member having vertical sides 11 and ends 12 with horizontal upper and lower flanges 13 which are suitably secured within the duct 10. An elongated manifold B is carried longitudinally of the frame between the end walls 12, and is positioned within an upper portion thereof as by a suitable flanged support 14. The manifold is capped at each end as at 15. The cap 15 serves as a positioning member and support for a pipe C which is illustrated in the drawing as carrying water from a suitable source in the direction of the arrows in FIG. 2 from the inlet end of the left-hand side to an outlet end on the right-hand side. It is possible that the liquid carrying pipe C may be provided with internal or external thermal fins. A space 17 around the fins 16 about the pipe C is provided within the manifold B.

Figure 2:
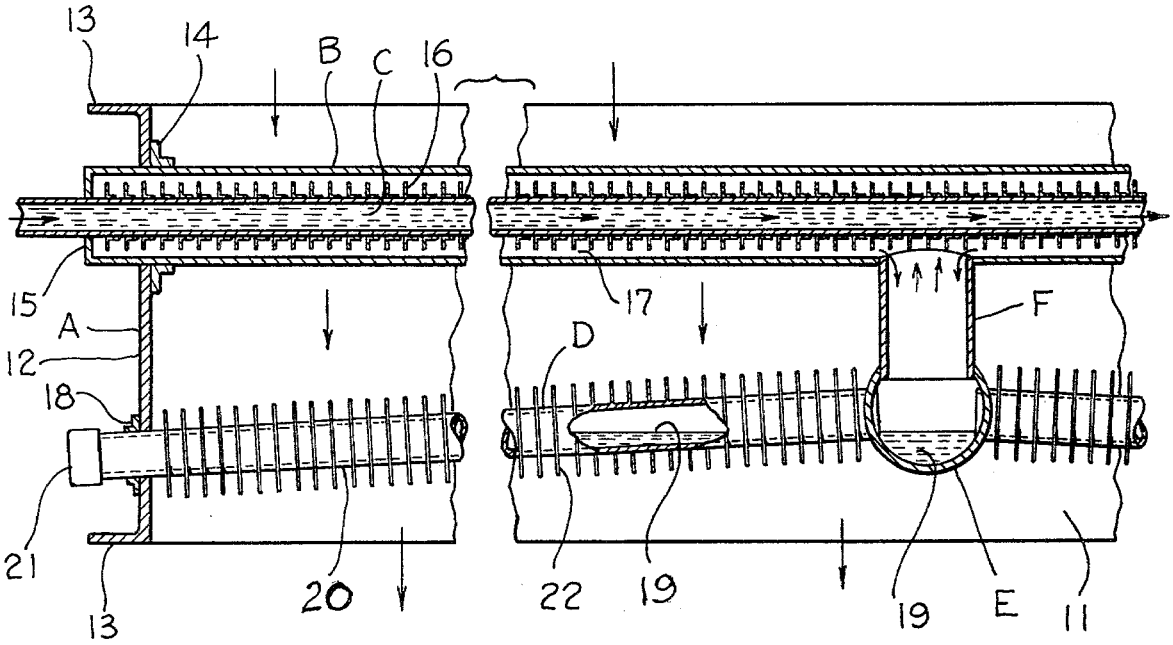
FIG. 2 is an enlarged longitudinal sectional elevation taken on the line 2—2 in FIG. 1, with parts broken away and parts omitted.

Beneath the manifold, an array of generally horizontal heat tubes are illustrated at D being positioned on each side of a collector pipe E. The heat pipes are supported on one end by the collector pipe E, and on the other end as by a suitable fitting 18 within the end walls 12 of the frame A. The heat tubes D comprise the usual pipe member 20 which carries a vaporizable medium 19 therein which communicates with the fluid or vapor 19 within the collector pipe E. The end of the heat pipes opposite the fitting 18 are connected in fluid flow relationship with the collector pipe E and the adjacent end of the heat pipes open into the collector E to permit flow of vapor or liquid phase vaporizable material, or both. The other ends of the heat pipes are closed and capped as illustrated at 21. These ends of the collector pipe E are supported within the frame sides 11 and are capped as illustrated at 23. Preferably, the heat pipes D are provided with suitable thermal fins as illustrated at 22. Means is provided for connecting the collector pipe E to the manifold B as by a stand pipe or vertical conduit F. As illustrated in FIG. 2, the vapor phase of the heat transfer medium is shown ascending centrally of stand pipe F by upward arrows, while the liquid phase flows downwardly adjacent the inside walls of the pipe F.

It is to be understood that any suitable type of working fluid medium may be employed in connection with the heat pipes and manifold as, for example, one of the Freons or a variety of organic fluids such as methanol or even Hydrogen may be employed for cryogenic applications. If difficulty is experienced in carrying out the evaporation and condensation phases to accommodate vapor and liquid flow of the heat transfer medium, suitable wicks or baffles or other desirable means may be employed. Also, a preferred material compatible with the liquid and the medium, such as copper, may be utilized in connection with the various heat transfer elements and since in the embodiment illustrated, building structure applications are contemplated, it may be preferable that the liquid vapor medium may be of a non freezing variety. It may be possible to run the water pipe directly through a pipe such as the collector pipe E which would then serve as a manifold pipe. In the embodiment shown the collector pipe, the stand pipe and the manifold all serve as manifold means for receiving heat transfer medium from the heat pipes.

It is to be especially noted that by inverting the heat exchange apparatus illustrated so that the water pipe and manifold is below the heat pipe array, that the system may be made to work in reverse, that is to heat gas with a hot liquid. In such a system, heat is transferred from the fluid such as water, to gas such as air.

Figure 3:
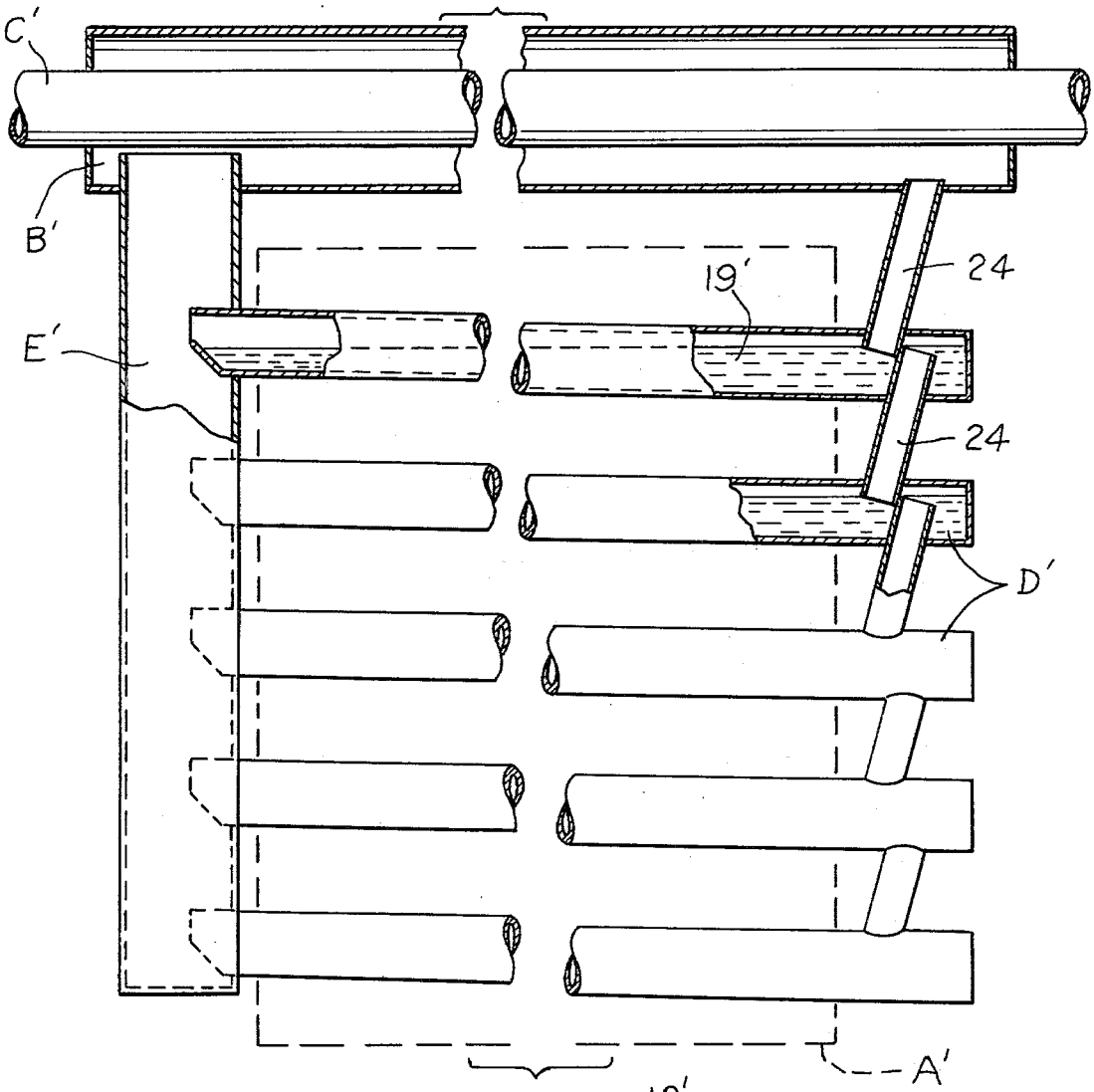
FIG. 3 is a schematic front elevation, with parts broken away, illustrating a modified embodiment of the invention.

While the various components of heat transfer apparatus have been illustrated being disposed generally horizontally, it is to be understood that the elements may be otherwise disposed as, for example, the heat pipe arrays may be arranged vertically so that they are vertically spaced along a collector pipe such as the pipe E′ in FIG. 3. A vertical frame A′ is illustrated schematically in broken lines in FIG. 3 for carrying a horizontal flow of heated air. In this embodiment, it is necessary to provide overflow connections 24 between the ends of the vertically spaced heat pipes D′ remote from the collector pipe so as to maintain a desired liquid level in all the pipes. In this embodiment the collector pipe serves also as a stand pipe. The pipes 24 are offset with respect to adjacent pipes in vertical alignment.

Figure 4:
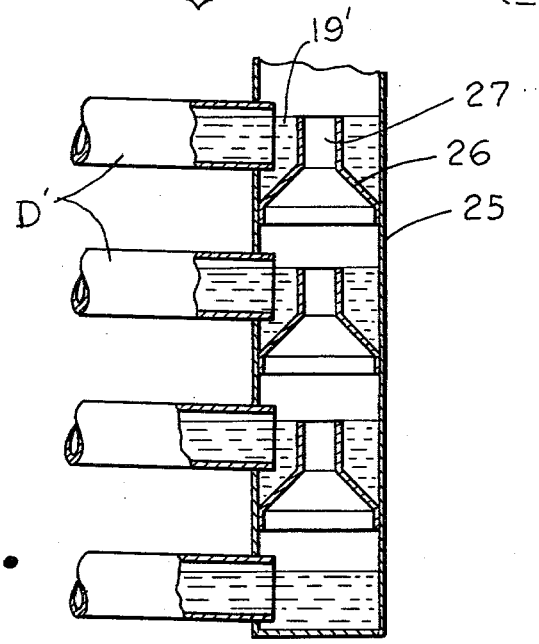
FIG. 4 is a front elevation, with parts broken away, illustrating a further modified embodiment of the invention.

FIG. 4 illustrates a further modified embodiment wherein vertically spaced heat pipes D′ are employed with overflow means arranged in a vertical overflow pipe 25. The overflow means include a liquid trap formed from a baffle 26 which has an upper extension 27 serving as an overflow pipe to maintain the proper level of the medium 19′ in the heat pipe D′.

While a preferred embodiment of the invention has been described using specific terms, such description is for illustrative purposes only, and it is to be understood that changes and variations may be made without departing from the spirit or scope of the following claims.

What is claimed is:

1. Heat pipe heat exchange apparatus for conducting heat between a gas stream and a liquid comprising:

an elongated substantially horizontal manifold;

a liquid carrying pipe extending within said manifold in spaced relation thereto;

a plurality of spaced heat tubes having a vaporizable liquid medium partially filling same;

means mounting said heat tubes in heat exchange relation to said gas stream in a generally side-by-side manner for individual contact with said gas stream;

conduit means communicating with said manifold for collecting said liquid medium from said heat tubes for controlling the liquid level therein and for conveying vaporized medium into said manifold in heat exchange relation to said liquid within said pipe;

said spaced heat tubes having one end carried by said conduit means being open thereto and an opposing end extending away therefrom;

said heat tubes being substantially horizontal relative to said conduit means so that said liquid medium in said heat tubes is maintained at a level at which said tubes are only partially filled along substantially the entire length thereof; and said heat tubes being carried by opposing sides of said conduit means extending outwardly from both said sides in substantially horizontal relationship.

2. The structure set forth in claim 1 wherein said conduit means for collecting and conveying the medium includes an elongated horizontal collector pipe having connection with said heat tubes, and a conduit conveying the medium from said collector pipe to said manifold.

3. The structure set forth in claim 2 including heat exchange fins carried by said liquid carrying pipe within the manifold.

4. The structure set forth in claim 1 wherein said heat tubes are disposed in generally horizontal planar alignment, said conduit and collector means for collecting and conveying the vapor includes an elongated collector pipe having connection with said heat tubes, and an upright conduit conveying the vapor from said collector pipe to said manifold.

5. The structure set forth in claim 1 wherein said conduit means, manifold and heat tubes are carried substantially horizontally by a horizontal frame.

* * * * *